US007033490B2

(12) United States Patent
Blackman et al.

(10) Patent No.: US 7,033,490 B2
(45) Date of Patent: Apr. 25, 2006

(54) FLOATING, MULTI-DIRECTIONAL POOL SKIMMER

(76) Inventors: Gary Palmer Blackman, 316 Mid-Valley Center, Carmel, CA (US) 93923; Kent Brian Zilliox, 4 Buena Vista Del Rio, #A, Carmel Valley, CA (US) 93924

( * ) Notice: Subject to any disclaimer, the term of this patent is extended or adjusted under 35 U.S.C. 154(b) by 3 days.

(21) Appl. No.: 10/779,081

(22) Filed: Feb. 14, 2004

(65) Prior Publication Data

US 2004/0182768 A1 Sep. 23, 2004

Related U.S. Application Data

(60) Provisional application No. 60/448,059, filed on Feb. 15, 2003.

(51) Int. Cl.
*E04H 4/14* (2006.01)

(52) U.S. Cl. ..... 210/169; 210/238; 210/242.1; 4/496

(58) Field of Classification Search ..... 210/169, 210/170, 232, 238, 242.1; 4/496
See application file for complete search history.

(56) References Cited

U.S. PATENT DOCUMENTS

| | | | | |
|---|---|---|---|---|
| 2,706,664 | A * | 4/1955 | Conrad | 403/187 |
| 4,176,419 | A | 12/1979 | MacDonald | |
| 4,472,842 | A | 9/1984 | Jarrett | |
| 4,518,495 | A | 5/1985 | Harding | |
| 4,820,411 | A | 4/1989 | Lempio | |
| 4,822,487 | A | 4/1989 | Soich | |
| 4,889,622 | A | 12/1989 | Newcombe-Bond | |
| 5,043,060 | A | 8/1991 | Brennan | |
| 5,223,135 | A | 6/1993 | MacPhee | |
| 5,279,728 | A | 1/1994 | Weiss | |
| 5,422,001 | A | 6/1995 | Yagoda | |
| 5,614,085 | A | 3/1997 | Platt, III | |
| 5,705,058 | A | 1/1998 | Fischer | |
| 5,911,878 | A | 6/1999 | Benvenuto | |
| 5,951,858 | A | 9/1999 | Soto | |
| 6,132,604 | A | 10/2000 | Kirchoff | |
| 6,358,410 | B1 | 3/2002 | Lambert | |
| 6,383,374 | B1 * | 5/2002 | Splendorio | 210/169 |
| 6,672,039 | B1 * | 1/2004 | Shonnard | 56/8 |
| 2004/0068914 | A1 * | 4/2004 | Wellard et al. | 43/12 |
| 2004/0108259 | A1 * | 6/2004 | Giannantonio | 210/169 |
| 2005/0097872 | A1 * | 5/2005 | Shonnard | 56/8 |

* cited by examiner

*Primary Examiner*—Fred G. Prince
(74) *Attorney, Agent, or Firm*—Peter Elias Fine

(57) ABSTRACT

A floating, multi-directional liquid skimming device, comprising a perimeter frame attached to a net, where the frame rotates relative to a central axis. A central axis element may be attached to a pole handle. Floatation elements can be located along the central axis. In operation, the frame floats at rest with the frame roughly parallel to the surface of the liquid, and where the top edge of the frame is above the liquid surface to retain collected debris. When the device is pulled toward the operator, the frame swivels relative to the surface, so the frame opening is facing the direction of travel, enabling capture of floating material. When the skimmer motion is stopped, inherent floatation causes the frame to quickly swivel back to the resting position. If the skimmer is pushed away from the operator, the frame opening swivels to face the new direction of travel.

18 Claims, 19 Drawing Sheets

END CAP ASSEMBLY DETAIL

FLOATING, MULTI-DIRECTIONAL POOL SKIMMER

The applicant for utility patent coverage in the U.S. for the invention taught, enabled, and claimed in this application for Letters Patent, hereby incorporates by reference herein, and under 37 CFR 119(e) claims the benefit of priority of the respective filing date accorded the following provisional patent application earlier filed with the U.S. Patent and Trademark Office, namely:

U.S. Provisional Patent Application No. 60/448,059 filed Feb. 15, 2003 and entitled "Manual Debris Collection Device for the Upper Area of a Body of Water"

FIELD OF THE INVENTION

The present invention relates to a device for cleaning debris from the surface of a body of liquid, and more particularly to a liquid skimming device feature multidirectional cleaning.

BACKGROUND OF THE INVENTION

The invention relates to skimmers for use in cleaning debris located at or near the surface of a liquid. In particular, the invention is useful as a pool skimmer for cleaning debris located at or near the surface of water contained within a swimming pool.

Most swimming pools have automatic skimming capability in the form of a front-end filter associated with a pump that circulates the pool water. By its nature, automatic surface debris collection occurs only when debris randomly floats by the filter opening. Since outdoor pools are constantly exposed to all airbourne debris, there is usually some amount of floating debris on the surface at any one time. To quickly and thoroughly clean the surface of a swimming pool prior to its use, a manual device must be employed. A number of such devices have been developed in the art for dealing with pool debris. The most common device for manually removing debris at or near the surface of swimming pools is a basket with a screen or net attached to the end of a pole. A net frame, to provide an opening for these screens is typically parallel to the plane or direction of the pole and the attached screen or net may be shallow or relatively deep, depending on the desired capacity. These devices have no floatation and are operated by manipulating the attached pole to capture debris through the opening of the attached screen or net device. The most common of these devices have openings ranging from one to one and a half square feet and require many passes through the water to remove and clean the upper area of a typical swimming pool. Since these devices have no floatation and must be manually cantilevered out, into the pool and passed up, down and side to side through the water, operator fatigue and back strain are common. The farther a conventional skimmer gets from the operator, the harder those devices are to operate, and fatigue and back strain are more severe.

Some conventional skimming devices are larger and include floatation, enabling the devices to be towed or dragged by a tether about the surface of the water, thereby eliminating the cantilever forces on the operator's body. Since these devices must still be manipulated in a lateral fashion at the end of a long attached pole and since they're larger and offer increased drag, operator fatigue and back strain are still common.

U.S. Pat. No. 4,518,495, issued to Harding, provides one form of conventional skimmer that includes floatation. Harding's pool skimmer is designed to be pulled in only one direction. If Harding's pool skimmer is flipped over, it will no longer be fully operational, as designed. Also, Harding's pool skimmer can not quickly reverse direction in a loose-gripped, one-handed manner. Such an attempt would risk fouling its long, trailing net and also the liklihood of release of captured debris would be high. And, finally, Harding's skimmer offers no convenient means of capturing debris floating very close by or adhering to the vertical side of the pool.

U.S. Pat. No. 5,043,060, issued to Brennan, provides another form of conventional pool skimmer that includes floatation. Like Harding's skimmer. Brennan's pool skimmer can not quickly reverse direction in a loose-gripped, one-handed manner. Such an attempt would include the likelihood of release of captured debris. Finally, Brennan's skimmer offers no convenient means for capturing debris floating very close by or adhering to the vertical side of the pool.

U.S. Pat. No. 5,614,085, issued to Platt, provides a similar form of conventional pool skimmer that also includes floatation. Platt describes his skimmer as "omni-directional" and "operated in any direction reqardless of orientation," but the skimmer's tether has to be lifted through a one-hundred-eighty degree are to guide its opening to face the opposite direction, or be slowly turned one hundred eighty degrees to operate in the opposite direction. Like Harding's and Brennan's pool skimmers. Platt's pool skimmer can not quickly reverse direction in a loose-gripped, one-handed manner. Such an attempt would risk fouling its long, trailing net and also the likelihood of release of captured debris would be high. Finally, Platt's skimmer offers no convenient means for capturing debris floating very close by or adhering to the vertical side of the pool.

U.S. Pat. No. 6,358,410, issued to Lambert, provides a simple net attached to the end of a pole and containing removeable floatation elements. Even though the floats mitigate back-straining, cantilevered motion, it must still be manuipulated side-to-side and lifted frequently from the water for frequently cleaning. Like Harding's, Brennan's and Platt's pool skimmers. Lambert's pool skimmer can not quickly reverse direction in a loose-gripped, one-handed manner. Such an attempt would include the high likelihood of release of captured debris. Finally, Lambert's skimmer offers no convenient means for capturing debris floating very close by or adhering to the vertical side of the pool.

U.S. Pat. No. 6,383,374, issued to Splendorio, provides a simple net on a buoyent, articulating arm, which is, in turn, attached to a pole. This skimmer, with its angled handle, places a twisting load on the attached pole during its use. Like Harding's, Brennan's, Platt's and Lambert's pool skimmers. Splendorio's pool skimmer can not quickly reverse direction in a loose-gripped, one-handed manner. Such an attempt would include the high likelihood of release of captured debris. Spendorio's skimmer offers no convenient means for capturing debris floating very close by or adhering to the vertical side of the pool.

U.S. Pat. No. 4,176,419, issued to MacDonald, provides a deep net, attached to a pole and with brush bristles protruding laterally outwardly from the side surface of the frame. Because of the drag created by the many brush bristles, this skimmer requires substantial force to be applied, as it's manually manipulated from side-to-side and vertically through the water. MacDonald's pool skimmer offers no means to be operated in a loose-gripped, one-handed manner, nor was is designed to quickly reverse direction. While MacDonald's skimmer offers a means of dislodging debris very close along the vertical side of the pool, it must be manipulated through the water to subsequently capture the loosened debris.

U.S. Pat. No. 5,422,001, issued to Yagoda, provides an enlarged skimmer with a buoyancy component including a frame. The geometry between skimmer net end and the attached handle places a twisting load on the handle during its use. Yagoda's pool skimmer offers no means to be operated in a loose-gripped, one-handed manner. Yagoda's skimmer functions in one direction only and offers no convenient means for capturing debris floating very close by or adhering to the vertical side of the pool.

U.S. Pat. No. 5,951,858, issued to Soto, provides a device for cleaning a body of water by passing an elongated net having a C-shaped cross section over the surface and slightly immersed in the water. While this device contains a wheel to facilitate movement along the deck adjacent to the pool, the complicated geometry between the skimmer and the handle assembly requires the operator to keep both the fore-and-aft angle of attack and vertical alignment of the net with the surface of the water within a narrow range. Soto's pool skimmer offers no means to be operated in a loose-gripped, one-handed manner. Also, Soto's skimmer functions in one direction only and offers no convenient means for capturing debris floating very close by or adhering to the vertical side of the pool.

U.S. Pat. No. 4,822,487, issued to Soich, provides a skimming device for a swimming pool that includes an elongated rectangular frame having a screen extending within the area bounded by the frame. The skimmer is operated via a telescoping handle. This device amounts to a simple rectangular net connected to a handle. It contains no floatation and must be manually cantilevered out, into the pool and passed up, down and side to side through water, causing operator fatigue and back strain. Soich's pool skimmer offers no means to be operated in a loose-gripped, one-handed manner. Also, Soich's skimmer functions in one direction only and offers no convenient means for capturing debris floating very close by or adhering to the vertical side of the pool.

U.S. Pat. No. 5,705,058, issued to Fisher, provides an in-pool skimmer for maintaining large area swimming pools and demarcated swimming areas free of offensive floating debris. In place of traditional perimeter operation of a pool skimmer, the in-pool skimmer floats within the pool and is directed by an operator either walking behind or swimming behind the skimmer, guiding the skimmer with its convenient handles. This skimmer must be guided by an operator in the water with the skimmer and is intended for very large pools or demarcted swimming areas. Fischer's pool skimmer offers no means to be operated in a loose-gripped, one-handed manner. While it contains floatation and retains captured debris when left unattended, it functions in one direction only. Filcher as skimmer is not intended for use in a conventional swimming pool.

U.S. Pat. No. 5,223,135, issued to MacPhee, provides for a net for removing debris, mounted on a frame which is extendable across the width of a swimming pool. This device must be operated by two people and is intended to clean a pool with one pass of the net along the pool's length. The vertical sides of the net are held away from the vertical side of the pool by rounded or ball-type elements to facilitate its travel and prevent damage to the pool sides. There is no means for conveniently retaining all captured debris as the device is removed from the water, so follow-up cleaning may be necessary with a small, conventional skimmer net. MacPhee's pool skimmer offers no means to be operated in a loose-gripped, one-handed manner. Finally, MacPhee's skimmer offers no convenient means for capturing debris floating very close by or adhering to the vertical side of the pool.

U.S. Pat. No. 6,132,604, issued to Kirchoff, provides for one, or more, skimming baskets to be attached to an elongated pole and operated in a manual fashion as to pass the skimming baskets laterally through the water near the pool surface. One embodiment of the device requires two operators, one on each side of the pool. Kirchool's pool skimmer offers no means to be operated in a speedy, loose-gripped, one-handed manner, nor does it offer a convenient means for capturing debris floating very close by or adhering to the vertical side of the pool.

U.S. Pat. No. 4,472,842, issued to Jarrett, provides for a pool skimmer having an elongated, floating barrier constructed of a plurality of rigid, elongated floats disposed in end-to-end relation and covered by flexible netting, one end of the barrier having a member for anchoring the one end in engagement with the wall of a swimming pool and the other end of the barrier having manually graspable members for engaging the other end with the wall and for traversing the other end around the wall so that the barrier sweeps the pool surface and collects floating material, such as oil. This device seems to be optimized for the removal of oil from the surface of the water and not the convenient removal of floating debris. In fact, it is substantially inconvenient by its nature. It must be unpacked from its case and deployed across a pool for use then removed, cleaned, folded and stored. Jarrett's pool skimmer offers no means to be operated in a loose-gripped, one-handed manner.

U.S. Pat. No. 5,911,878, issued to Benvenuto, and U.S. Pat. No. 5,849,184, issued to Veillet, are typical of numerous passive devices that attach to the side of a swimming pool and collect debris as it floats by, driven either by the wind or a current created by the pump-driven filtration system. Passive skimmers, such as these, work only over long periods of time, during which, more debris accumulates by natural means on the pool surface. As a passive device. Benvento's pool skimmer offers no means to be operated in a speedy, loose-gripped, one-handed manner, nor does it offer a convenient means for capturing debris floating very close by or adhering to the vertical side of the pool.

U.S. Pat. No. 4,820,411, issued to Lempio, is an example of a free-floating passive device. It requires long periods of time to randomly collect floating debris, which, more debris accumulates by natural means of the pool surface. As a passive device, Lempio's pool skimmer offers no means to be operated in a speedy, loose-gripped, one-handed manner, nor does it offer a convenient means for capturing debris floating very close by or adhering to the vertical side of the pool.

U.S. Pat. No. 5,279,728, issued to Weiss, and U.S. Pat. No. 4,889,622, issued to Newcombe-Bond, are typical of automatic skimming devices that function in conjunction with existing pump-driven filtration system in most pools. They also require long periods of time to randomly collect floating debris, during which more debris accumulates by natural means on the pool surface. As unattended automatic devices. Weiss + and Newcombe-Bond's pool skimmers offer no means to be operated in a speedy, loose-gripped, one-handed manner, nor do they offer a convenient means for capturing debris floating very close by or adhering to the vertical side of the pool.

It is an object of the present invention to provide a floating surface skimmer, which is multi-directional in nature i.e., it can collect floating debris whether it's pushed away from the operator or pulled toward the operator.

It is an object of this invention to provide a floating surface skimmer a portion of which swivels relative to the surface of a body of liquid, to provide multi-directional skimming without changing location of the operator.

It is further object of the invention to provide a floating surface skimmer, which is easily operated in a loose-gripped, push-pull fashion only and does not require strenuous cantilevered lifting or side-to-side manipulation.

It is a further object of the invention to provide a surface skimmer, which is capable of also collecting debris floating very close by, or adhering to the vertical side of a pool.

It is a further object of the invention to provide a surface skimmer, which contains floatation elements within the perimeter of the device, leaving the entire outside of the perimeter free for debris collecting functions.

It is further object of the invention to provide a surface skimmer with a range of operation limited only by the length of the attached pole.

SUMMARY OF THE INVENTION

A floating multi-directional liquid-skimming device which quickly and efficiently gathers, traps and retains floating material. The skimming device is capable of quickly changing direction with minimal effort, and without dumping the collected debris. The device can be pushed and pulled repeatedly across the surface of a body of fluid, such as a swimming pool, by an attached pole, chain, tether, or by automated means. The device comprises a perimeter frame attached to a debris collection net, where the frame can rotate relative to a central axis. The central axis may have a central axis element, such as an axle or spindle, rotate-ably connected to the perimeter frame, with said spindle fixedly attached to a pole handle. The frame can be rotate-ably attached to the central axis element in many different ways, such as by snapping the central axis element into pivot points in the frame. Alternative configurations can also be used to rotate-ably attach the swivel frame to a handle. One such configuration could include a central axis ball fixedly connected to the frame, where the ball is loosely confined within a confinement ring, and the ball is free to rotate within the ring. The confinement ring could then be fixedly attached to the pole, so that the skimmer basket is free to swivel or rotate relative to the handle, and relative to the liquid surface. Floatation of the skimmer can be enabled by either utilizing trapped air pockets, or by attaching one or more positive buoyancy floatation elements, such as foam balls. Floatation elements may be attached along a central axis element, or may be attached in alternative configurations, such as along the edges of the frame. In typical operation, the basket frame floats at rest so that the frame is roughly parallel to the surface of the liquid body, with the top perimeter edge of the frame above the liquid surface, to retain debris. If the skimmer device is pulled toward operator, the basket frame swivels relative to the surface of the liquid with the opening of the basket facing the direction of travel, to enable trapping of floating material. When the skimmer is stopped, inherent floatation and/or trapped air causes the basket to quickly swivel back to a resting position parallel to surface, retaining entrapped material. If skimmer is then pushed back across the surface, such as away from the operator, the basket again swivels, with the basket opening facing the new direction of travel. Quick and efficient swiveling can be induced by inherent flanges, to catch the liquid along the current leading edge, forcing submersion of the leading edge, and elevation of the trailing edge.

The basket frame can comprise downward-flared fins on its leading and trailing edges to facilitate swivel rotation when changing between the push and pull direction of travel. A neutral resting position which allows the device to retain collected material can be enabled by constructing the frame such that air pockets are trapped under the leading and trailing edges of the frame. The inventive skimmer may further comprise small outward-flared fins on each side to facilitate collection of debris floating very close along the vertical wall of a swimming pool. When the device is pulled or pushed along the vertical side of the swimming pool the small outward-flared fins guide debris floating very close the vertical wall into the device.

DETAILED DESCRIPTION OF THE INVENTION

Figure 1:
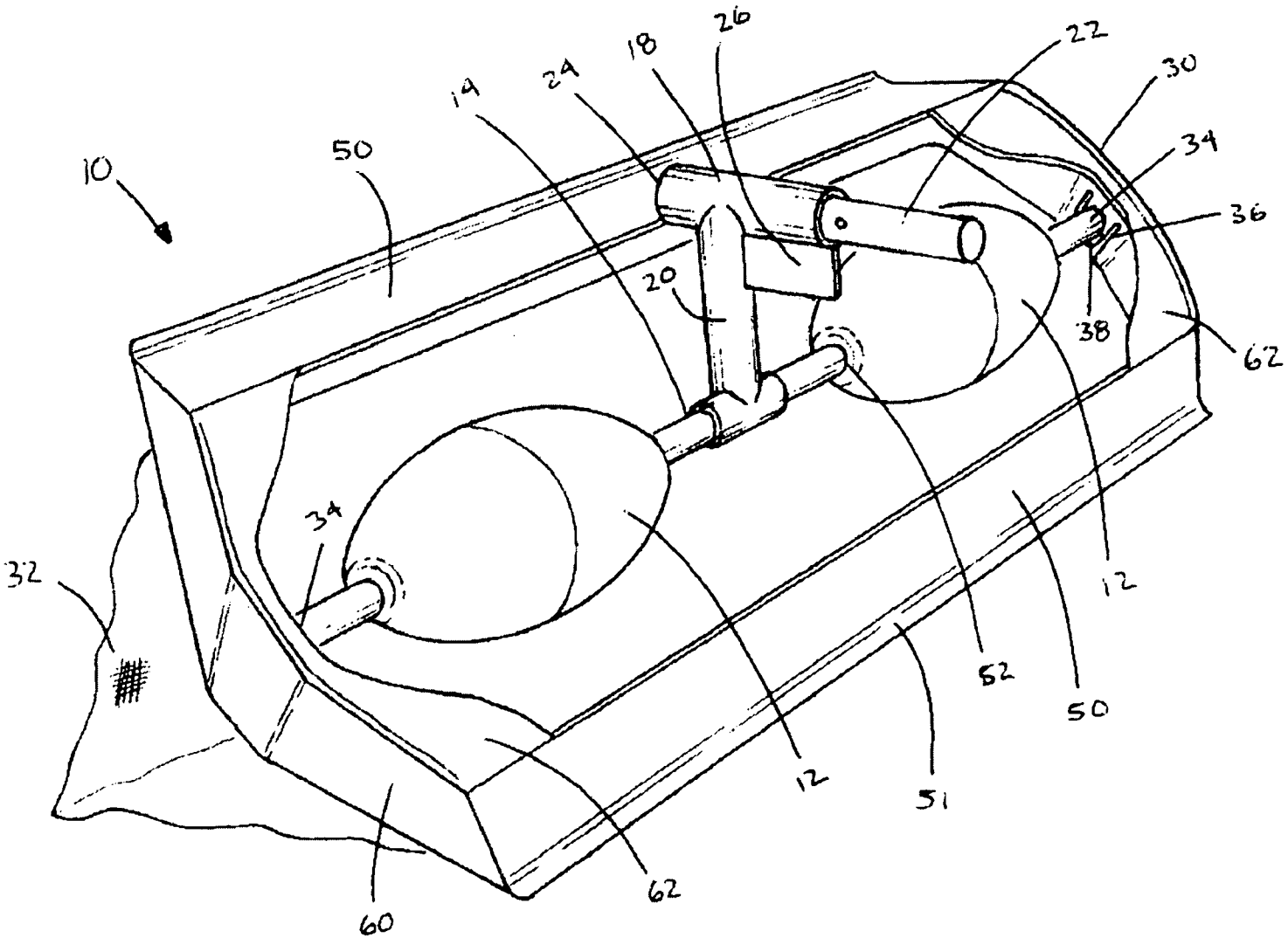
FIG. 1 Shows an example of the entire device, including the solid hoop with attached net and the axle assembly of a first embodiment, according to the invention.
Figure 2:
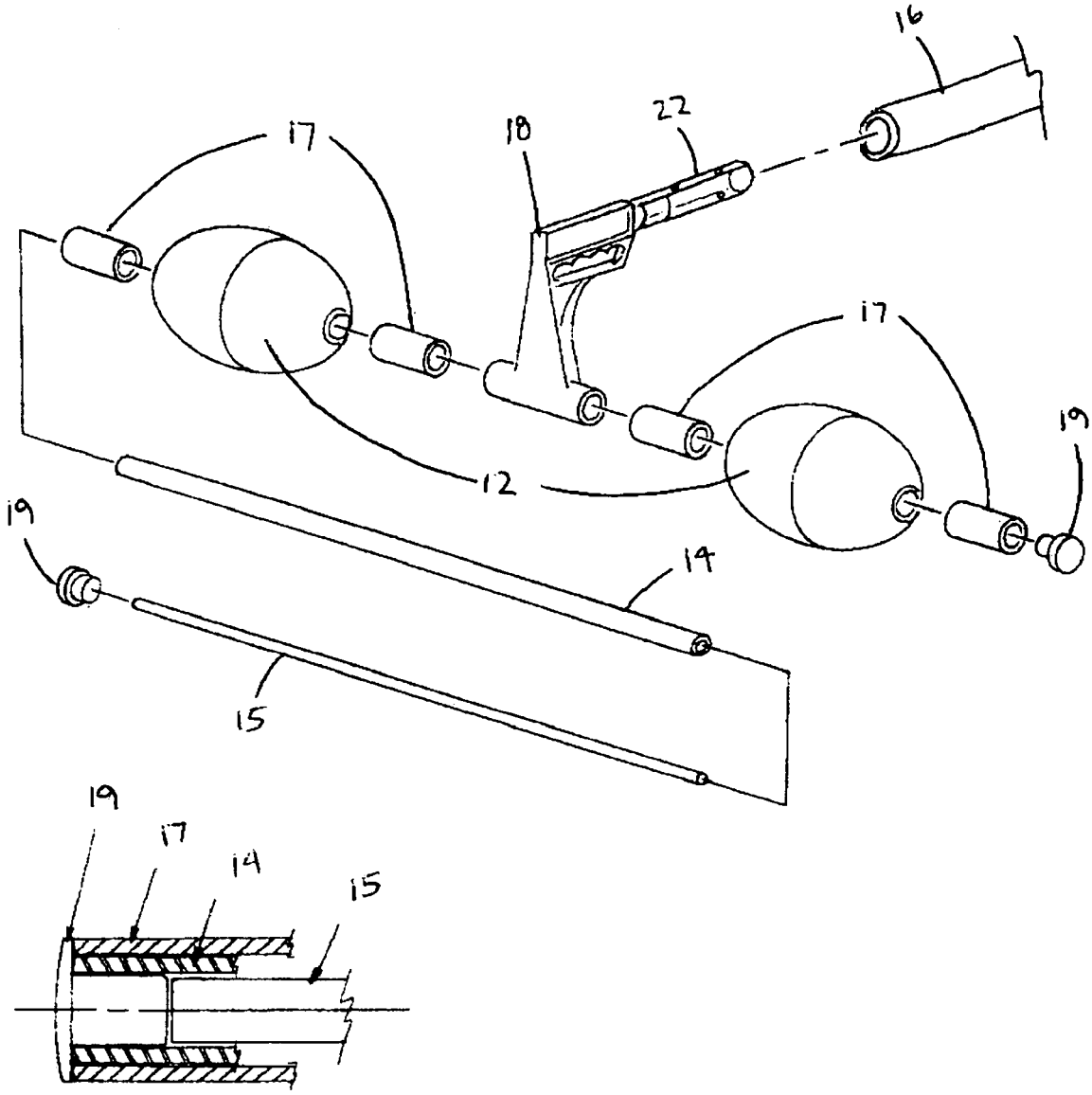
FIG. 2 Shows an example of the axle assembly, including the axle cross member, the attached floatation elements, the riser, the T-fitting, the pole insert and the two stops integrated into the first embodiment, according to the invention.
Figure 3:
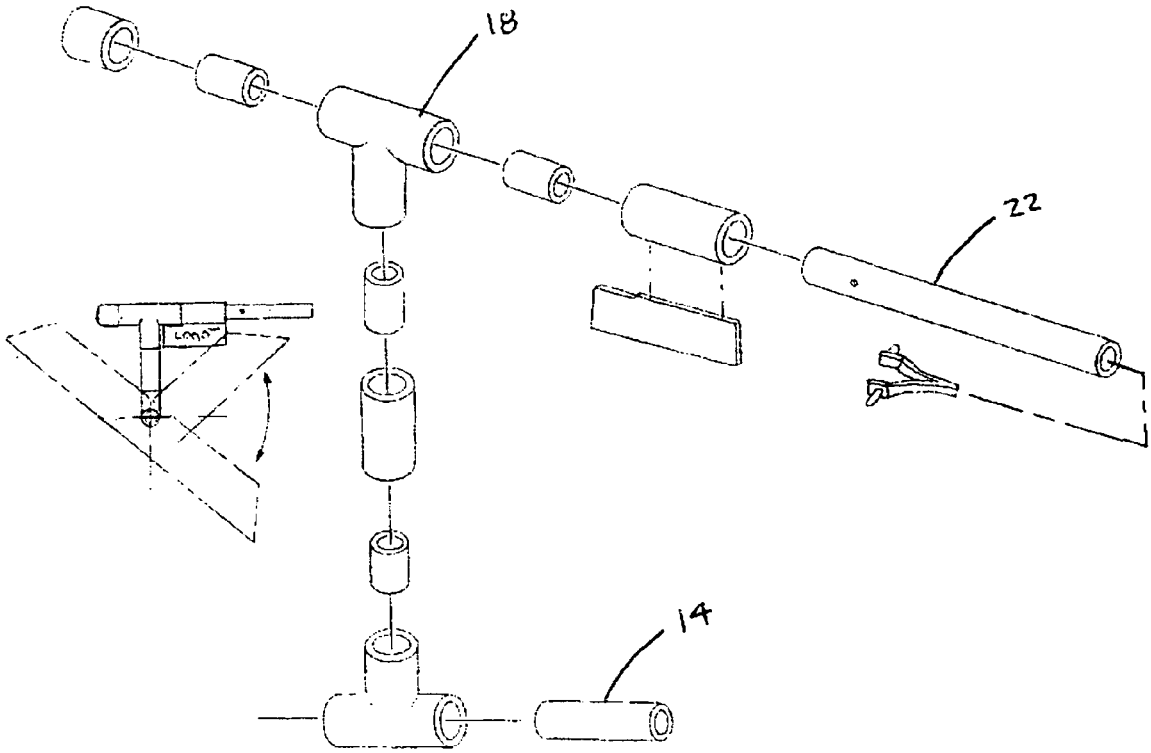
FIG. 3 Shows a exploded view as an example of the Riser, if it were made of conventional PVC plastic pipe, as opposed to an injected molded part.

FIG. 1 depicts a preferred embodiment of the invention. This particular preferred embodiment of the inventive skimmer 10 includes a pair of floatation elements 12 located along a central axis element 14. The central axis element 14 is attached to a pole handle 16 by a handle attachment element 18, as shown in FIG. 2. The handle attachment element 18 comprises a short vertical riser 20 which is fixedly attached to the central axis element 14. A handle attachment receiver 22 is attached to the riser 20 in an approximately perpendicular arrangement. Pole handle 16 is then attached to the receiver 22, such that the pole handle 16 is roughly perpendicular to the axis element 14, and preferably slightly above the plane of the axis. Angle stops 24 and 26 can also be included in the handle attachment element 18. Both the central axis element 14 and the handle attachment element 18 can be constructed from commonly available plastic PVC pipe material, and glued together with common waterproof PVC pipe glue, as depicted in FIG. 2 and FIG. 3. If PVC pipe is used to construct the central axis element 14, an insert 15 such as a wooded dowel or metal rod can be inserted into the center of the pipe comprising the axis element 14, for additional stiffening, as shown in FIG. 2. It should also be noted that to keep the floatation elements 12 correctly located, plastic spacers 17 can be added in the desired locations along the central axis element 14, as shown in FIG. 2. End caps 19 can also be connected to each end of the axis element to secure the assembly of the central axis element 14. Alternatively, these components can be formed by plastic extrusion or molding, or by using other suitable lightweight, waterproof materials and methods known to those skilled in the art.

Figure 4A:
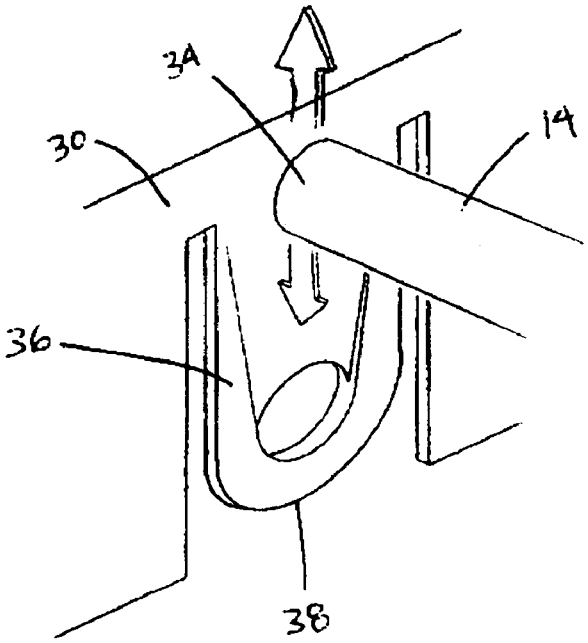
FIG. 4*a* Shows an example of how the axle is inserted into the tab hole using guides.
Figure 4B:
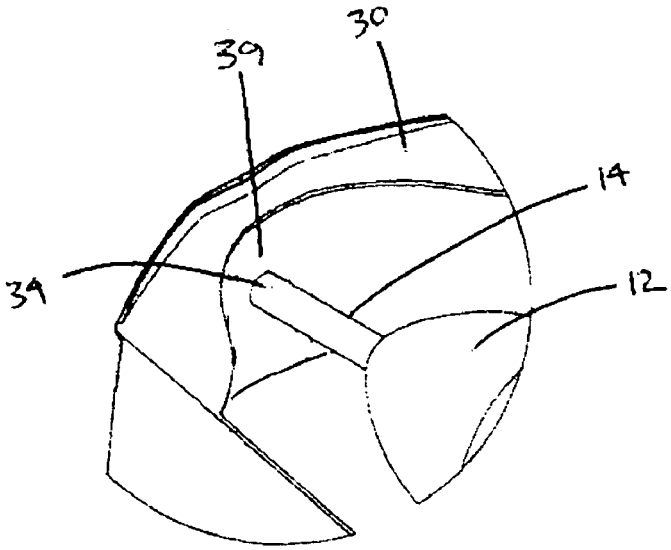
FIG. 4*b* Shows an example of how one side could have a receiving hole only (no tab)

Surrounding the central axis element 14 is a perimeter frame 30 which is pivotally attached to the central axis element 14. A debris capture net 32 is attached to at least a portion of the perimeter frame 30. In this embodiment, as depicted in FIG. 1, the axis element 14 is a straight plastic rod, or tube, with two identical axis element ends 34, although other configurations are certainly possible. The axis element ends 34 are each snapped into an axis element receiving site 36, such that the frame 30 is free to pivot, or swivel about the axis. The receiving site 36 can also be configured to allow the frame 30 and net 32 to be removed from the axis element 14 as a unit, as shown in FIG. 4*a*, for ease of emptying captured debris from the net 32. Since the frame 30 and net 32 will normally be removed from the axis element 14 and handle 16 after each use, the design of the skimmer should facilitate easy removal and replacement. In one possible embodiment, a retaining tab 38 is depressed at it's lower end, releasing an axis element end 34 for easy removal. To replace the frame 30 onto the axis element 14, the axis element end 34 is snapped back into place in the axis element receiving site 36. Both ends 34 of the axis element 14 can be snapped into indentical sites 36, or alternatively, one non-snap-able receiving site 39 can be used for a first end 34, and a snapping receiving site 36 can be used to receive the second end 34 to facilitate a rotate-able and removable attachment between the central axis element 14 and the frame 30. Thus with an easily removable basket frame, when the collection net is full or the skimming operation is completed the central axis element is separated from the basket frame, and the basket net can be easily dumped out and emptied.

Figure 5A:
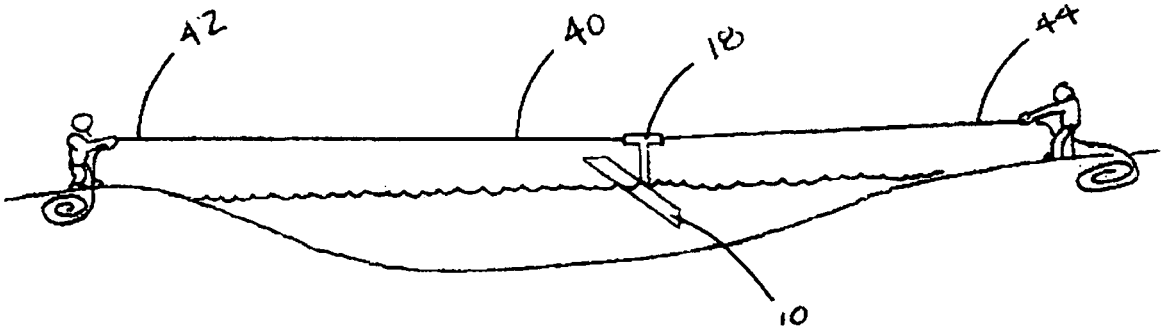
FIG. 5*a* Shows an example of the device tethered to cross a large body of water.
Figure 5B:
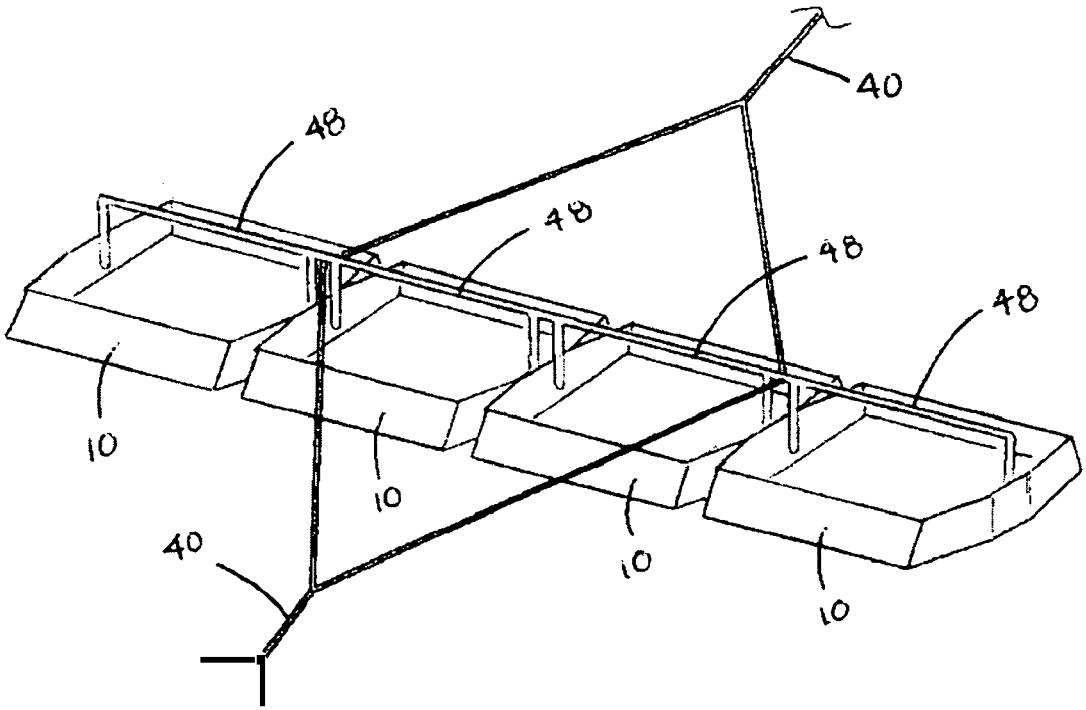
FIG. 5*b* Shows an example of multiple devices connected together to skim a larger width of surface.

The floating multi-directional skimmer 10 can be operated in several manners. A simple swimming pool skimmer for example can be easily operated by a single person, using a pole handle 16 as described above. Such a handle 16 could be a readily available aluminum or fiberglass pole, such as those commonly known and used in the swimming pool cleaning industry. The handle 16 can be snapped into the handle receiver 22, or threaded in for instance. Alternatively, instead of a pole handle 16, the skimmer device 10 can be controlled and operated using a stiff or a flexible tether 40 such as a cable, rope or chain as shown in FIG. 5*a*. For a tether-operated configuration, such as for skimming a large body of water such as a very large swimming pool, a pond, or other body of liquid, two operators can alternate pulling on the tether 40. Thus a first operator may pull a first tether end 42 until the skimmer is at his side of the pool. Then a second operator, positioned at the opposite end of the pool would pull on the opposite tether end 44 to draw the skimmer 10 back across the surface. The operators could then move along the edge of the pool, one skimmer width over, after each completed pull to effectively cover the surface for debris removal. Such a tether can be easily attached to the device, by connecting the tether 40 to the skimmer 10 using a suitable handle attachment 18, such as by tying on the tether 40 to the handle attachment 18, or by using drilled holes, clips or other suitable means as known to those skilled in the arts. The handle attachment could either be the same as in the pole operated version, or could be specially adapted to attach the tether 40. In other possible embodiments within the scope of this invention, the skimmer device 10 could be automatically moved across a body of liquid, such as by a propeller apparatus or by water jet locomotion (not shown). An automated or semi-automated configuration could be programmable to cover a desired pattern across a body of liquid. Also it should be noted that for skimming of large bodies of water, an array of multiple skimmers 10 connected together such as by a metal or plastic connecting frame 48, could also be employed as shown in FIG. 5*b*.

Many types of floating material and slightly submerged material can also be removed from the surface and also from slightly below the surface of a body of liquid, including pond algae, and even floating oil, if a suitable net 32 or collection basket is connected to the frame 30. One possibility for removing oil from a body of water may include the step of dispersing saw dust or other absorbent material across the oil slick, then drawing the skimmer 10 across the surface to collect the oil-soaked absorbent and thusly clean the water body surface.

Figure 6A:
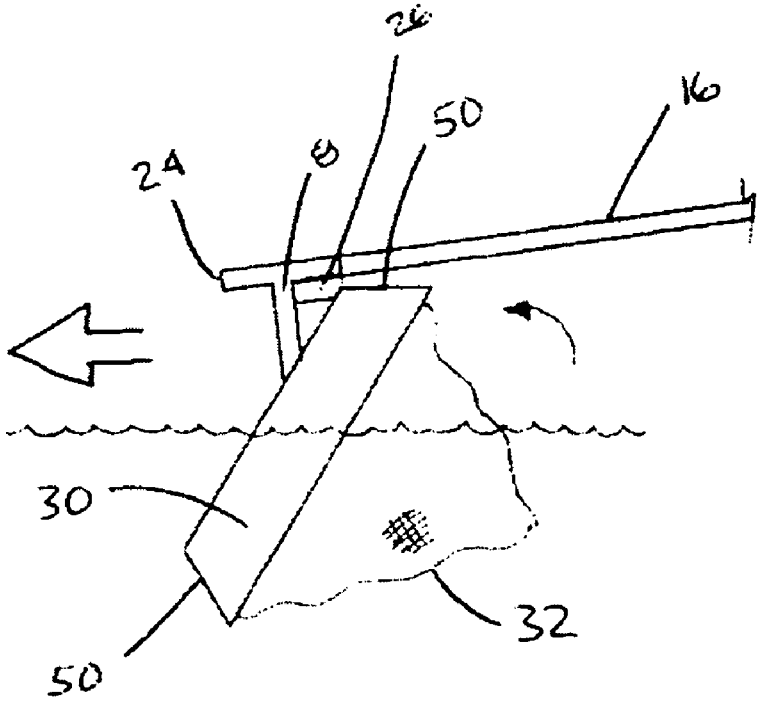
FIG. 6*a* Shows direction-of-travel orientation of the device, while being pushed.
Figure 6B:
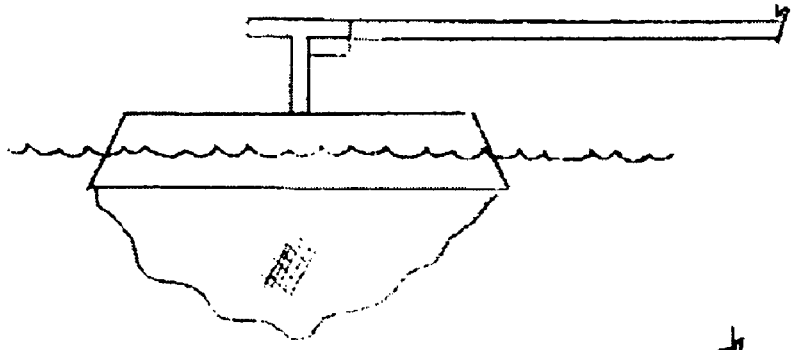
FIG. 6*b* Shows orientation of the device, while in resting position.
Figure 6C:
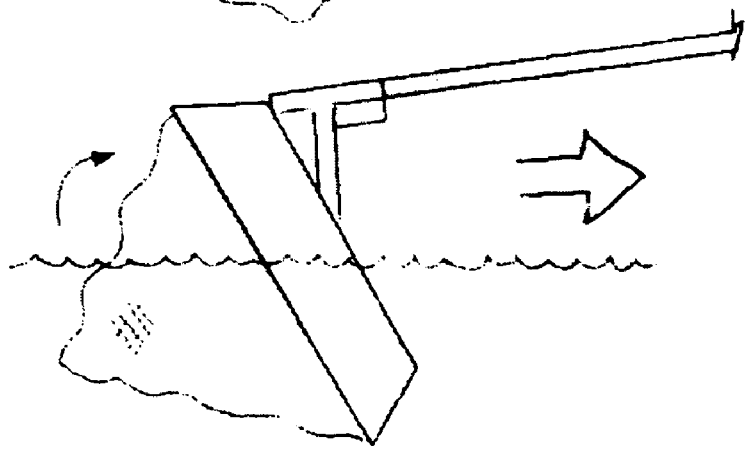
FIG. 6*c* Shows direction-of-travel orientation of the device, while being pulled.

In a pole operated configuration, a single operator alternately pushes and pulls the skimmer 10 across the surface. When the skimmer 10 is at rest, the floatation elements 12 bring the top of the perimeter frame 30 above the water's surface. When the operator pushes the pole 16, the skimmer 10 swivels relative to the water surface, such that the opening of the frame is facing the direction of travel, as shown in FIG. 6*a*. Angled-fins 50 are located on both sides of the net opening. The downward submerged portion of each fin facilitates rapid rotation of the opening toward the directional of travel. The upper portion, which extends above the waterline, facilitates retention of floating debris previously captured within the device during rotation and when the device is at rest. Angle stops 24 and 26 on either end of the handle attachment element 18 prevent the frame 30 from rotating past its maximum desirable range, as it travels both away from and toward the operator. During travel in either direction, approximately half of the frame 30 will be submerged and half will extend upward. In the resting position the floatation elements 12 holds the opening of the frame 30 above the surface to contain any floating debris previously captured by the device 10. Thus when the operator stops the motion of the handle 16, the device 10 rights itself to a resting position, holding collecting debris from escaping, as shown in FIG. 6*b*. When the operator then pulls the skimmer 10 back across the surface towards him, the frame 30 swivels in the opposite direction from the push motion, again so that the frame 30 opening is again facing the direction of travel, to allow for immediate multi-directional collection of debris, as shown in FIG. 6*c*.

Figure 7:
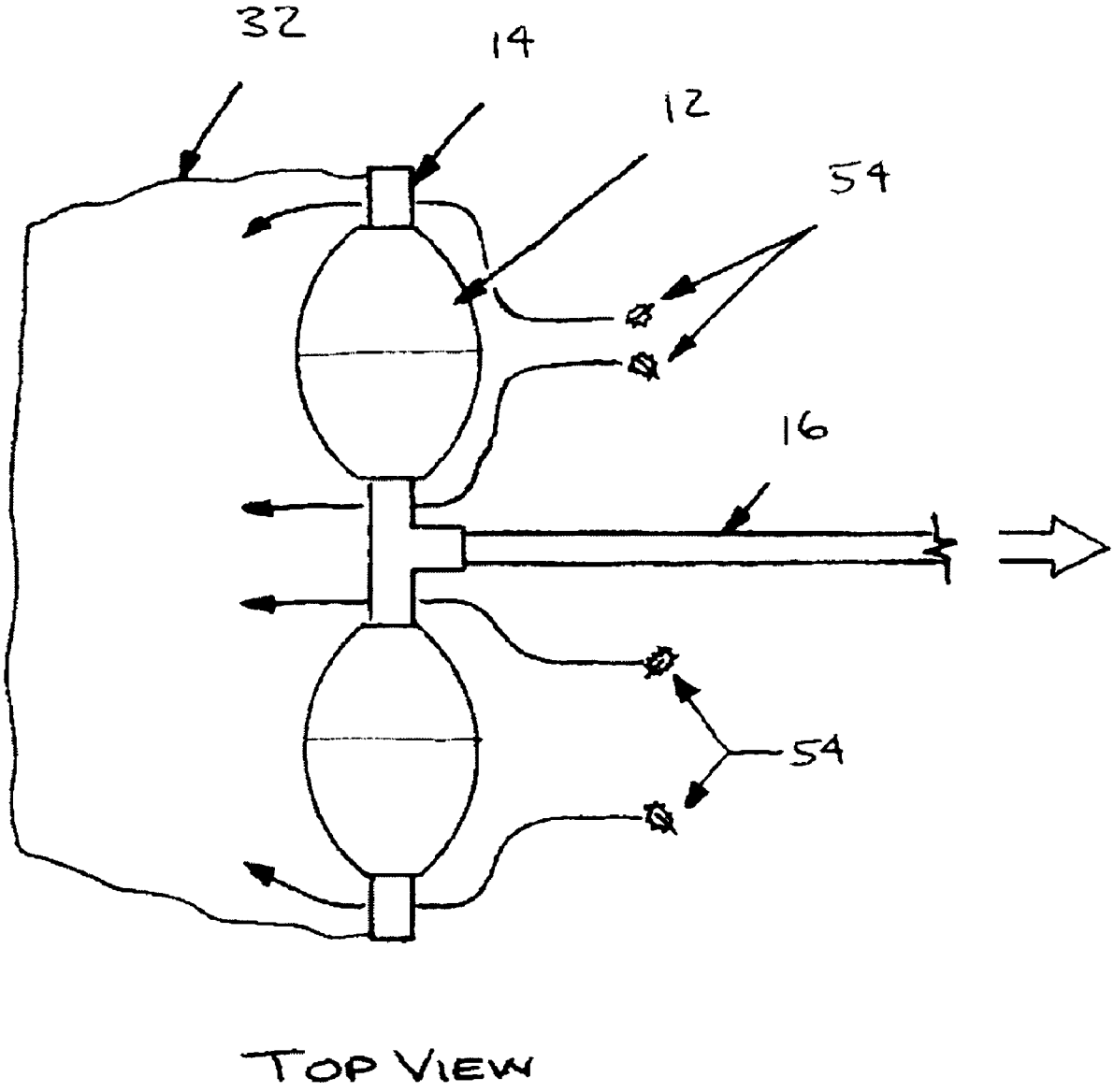
FIG. 7 Shows top view of device illustrating how debris enters device around and between floats and into net.

Preferably, each of the floatation elements 12 are oblong in shape, with the axis element 14 running through an internal passage 52 through the center of each floatation element 12. Fixed in this position, the floatation elements 12 present their long side to the direction of travel and, as they are either pushed or pulled through water, a laminar flow is created to facilitate movement of water and floating debris 54 smoothly around and between the floatation elements 12 and into the net 32 behind, as shown in FIG. 7.

Figure 8:
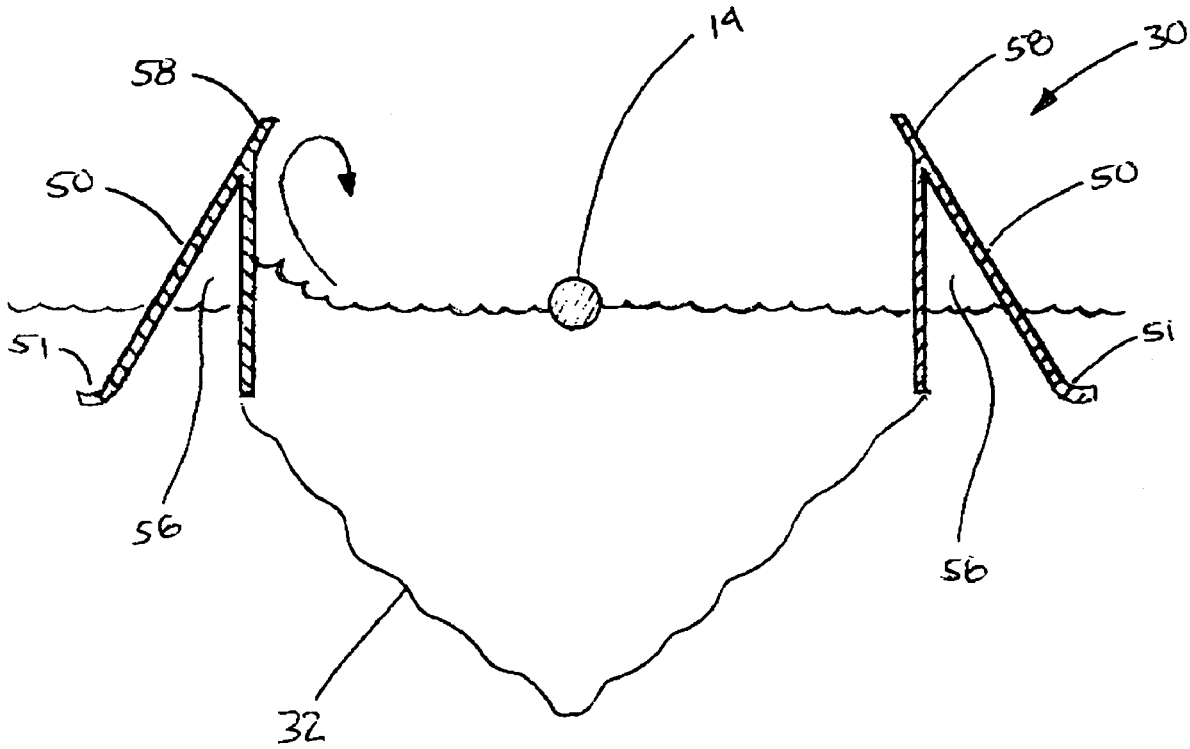
FIG. 8 Shows the air entrapment function of the long edges of the frame and debris retention function of the angled top edges on both long sides of the frame.

To optimize performance, the frame 30 opening contains angled fins 50 on its longer leading and trailing edges to catch the water and facilitate rotation between the push and pull direction of travel. Each angled fin 50 terminates in a short outward flare 51, as shown in FIG. 8, to facilitate downward pressure on the submerged edge as it passes through the water.

The frame 30 in the preferred embodiment, also has open downward-facing, hollow chambers 56 along its longer leading and trailing edges to capture air upon downward presentation to the water of each edge in turn. Thus when the skimmer 10 stops, the captured air in hollow chambers 56 help to very rapidly return the frame 30 to a resting position roughly parallel to the surface of the liquid. To optimize the retention of collected debris and prevent spilling of debris from the frame 30 and net 32, inward angled top edges 58 on both long sides prevent captured debris from sloshing out over the top. The inward-angled top edges redirect sloshing debris back into the center of the frame 30.

Another novel feature of this preferred embodiment of the invention skimmer 10, helps to prevent collected debris from sloshing out over the side edges 60, which is particularly useful during a change in direction of travel. By designing corner covers 62 into the edges of the frame 30, additional protection is achieved in preventing debris from flowing out of the frame 30.

Figure 9:
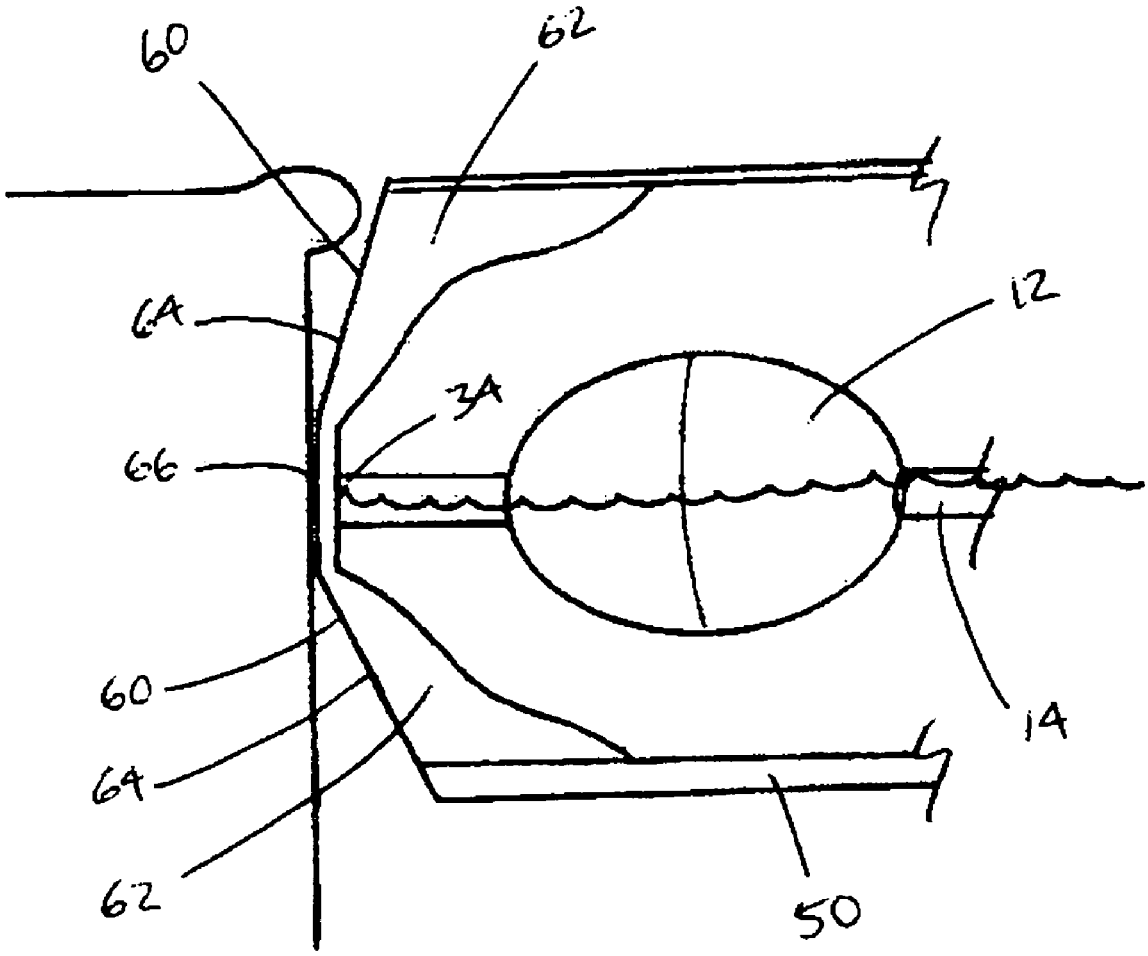
FIG. 9 Shows how the device is designed to scrape and clean the side surface (or sidewall) of a pool.

Yet another novel feature of the present skimmer invention 10 helps to clean the edges of a pool, which is especially useful for swimming pool skimming where the edge of the pool has an overhanging lip, or coping which is very common with in-ground pools. As shown in FIG. 9, the side edges 60, have angled sections 64 near the corners of the frame 30, and a flat section 66 near the center of each of the side edges 60 of the frame 30, in order to fit neatly under an overhanging pool edge and also to scrape clean the side wall during both push and pull motions, collecting debris efficiently from the very edges of the pool surface, where considerable amount of floating debris tends to cling.

Figure 10:
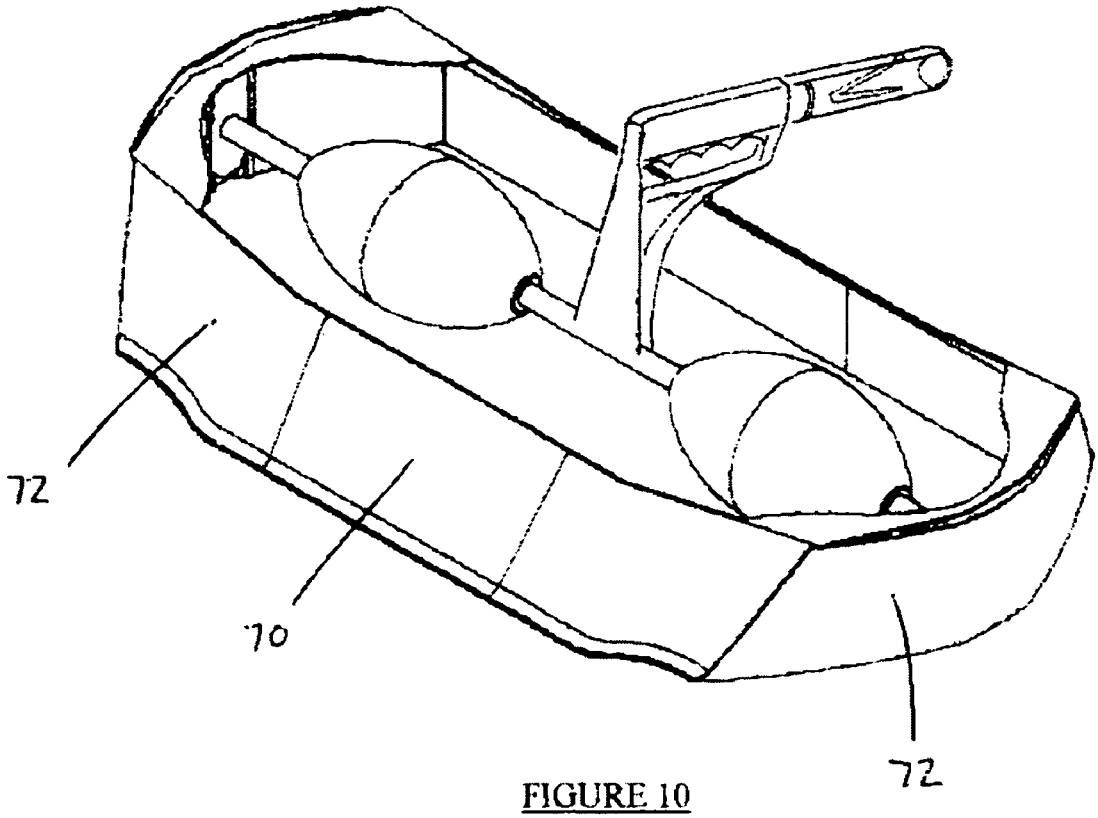
FIG. 10 Shows an example of an assembly of parts to form the frame.
Figure 11:
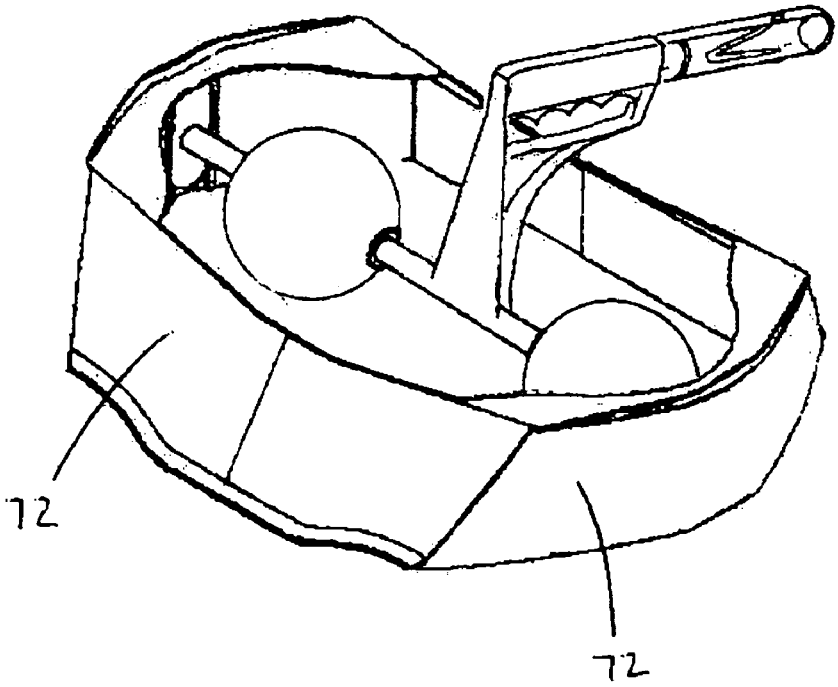
FIG. 11 Shows how a shorter version of the device can be assembled without the center section of the frame.
Figure 12A:
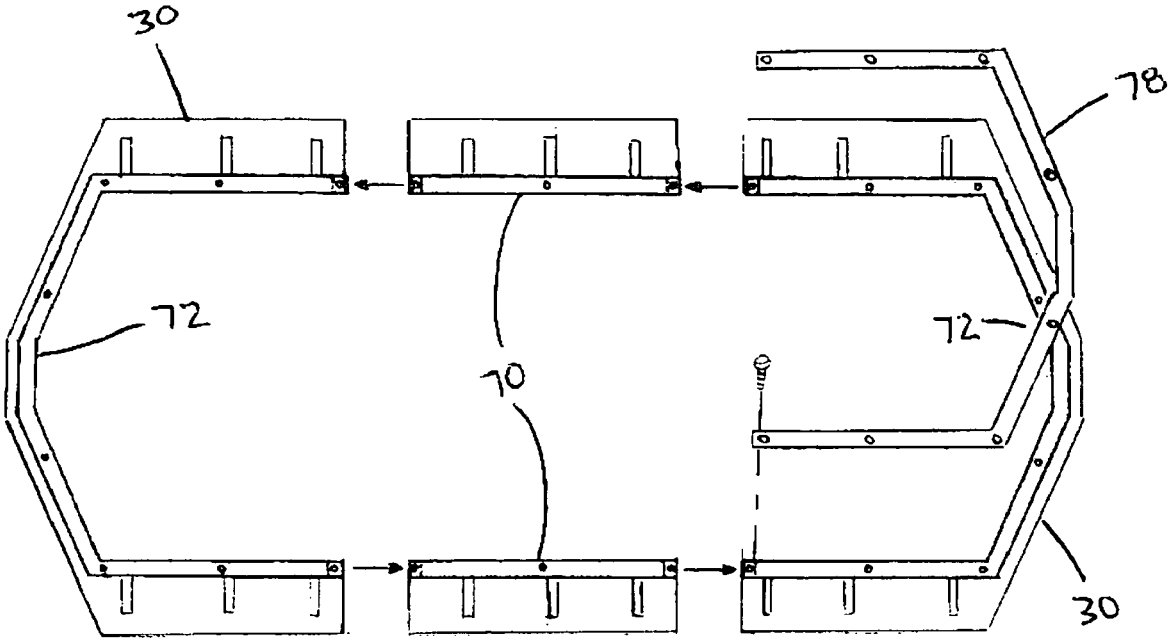
FIGS. 12*a* and 12*b* Show an example of how the net can be attached to the frame.
Figure 12B:
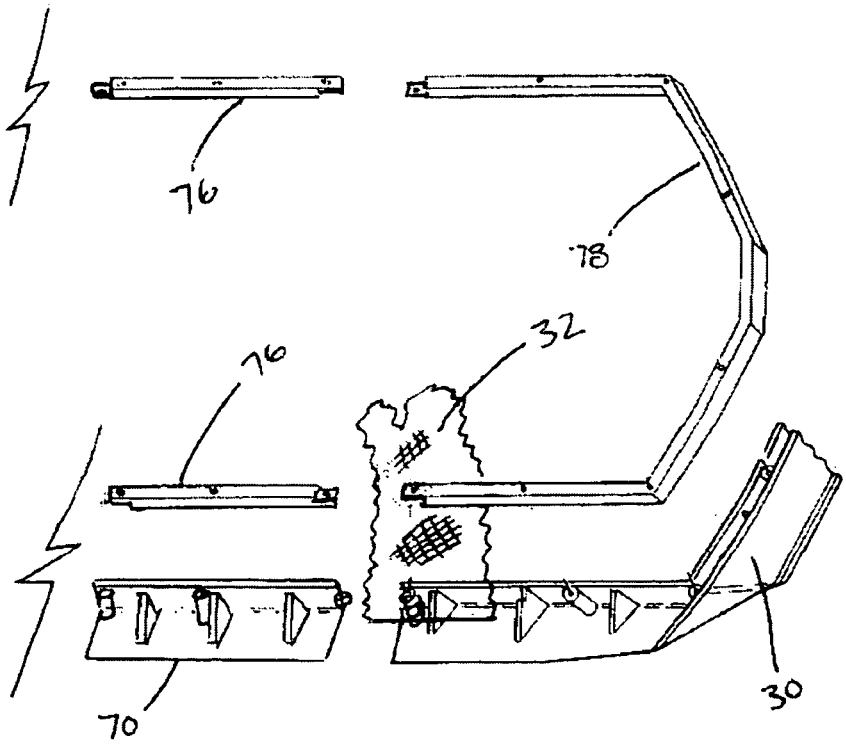

The frame 30 portion of the skimmer 10 can be manufactured in many shapes, sizes and configurations. A simple frame 30 could be made of PVC pipe. Molded plastic can also be used for the frame 30, which allows many of the features described above to be incorporated into the design. The frame 30 can be produced either as a single molded piece, or as an assembly of parts. One preferred embodiment of the frame 30 is shown in FIG. 10. A shorter version of this embodiment is shown in FIG. 11. In these embodiments, a frame 30 can be manufactured using two sets of identical parts, a set of straight parts 70 and a set of side end parts 72, as shown in FIGS. 12*a* and 12*b*. By manufacturing in smaller pieces, molding may be less expensive. Another inventive feature of manufacturing these two sets of parts 70 and 72 is that different sizes of skimmer 10 can be easily made from the parts 70 and 72. For instance, if two side end parts 72 are joined without any segments of straight parts 70, a short skimmer frame can be produced, as shown in FIG. 11. Alternatively, if one or more sets of straight parts 70 are used to separate the end parts 72, then larger (more elongated) skimmer frames 30 can be produced. The example of using one set of straight parts 70 to separate the end parts 72 is shown in FIG. 12*a*. Other larger frames 30 can also be produced in this manner.

The debris capture net 32 can be attached to the frame 30 in many possible configurations. In the presently described preferred embodiment, the net 32 is held in place or clamped between the frame 30 and a net hoop 74. The net hoop 74 can also be produced either as a single molded piece, or as an assembly of parts. One preferred embodiment of the net hoop 74 is shown in FIG. 12*b*. In this case, a net hoop 74 can be manufactured with two sets of identical parts, a set of straight hoop parts 76 and a set of side end hoop parts 78. The net hoop 74 can be attached to the frame 30 in many ways, such as bonded glue, screwed or bolted into place. The net 32 should be firmly secured to the frame to prevent it from becoming dislodged during use. However the method of attachment should allow the net 32 to be easily replaced. FIG. 12*b* depict a fastening method where the net 32 is firmly clamped between the frame 30 and the net hoop 74 using a set of screws 79 located around the perimeter.

Figure 13:
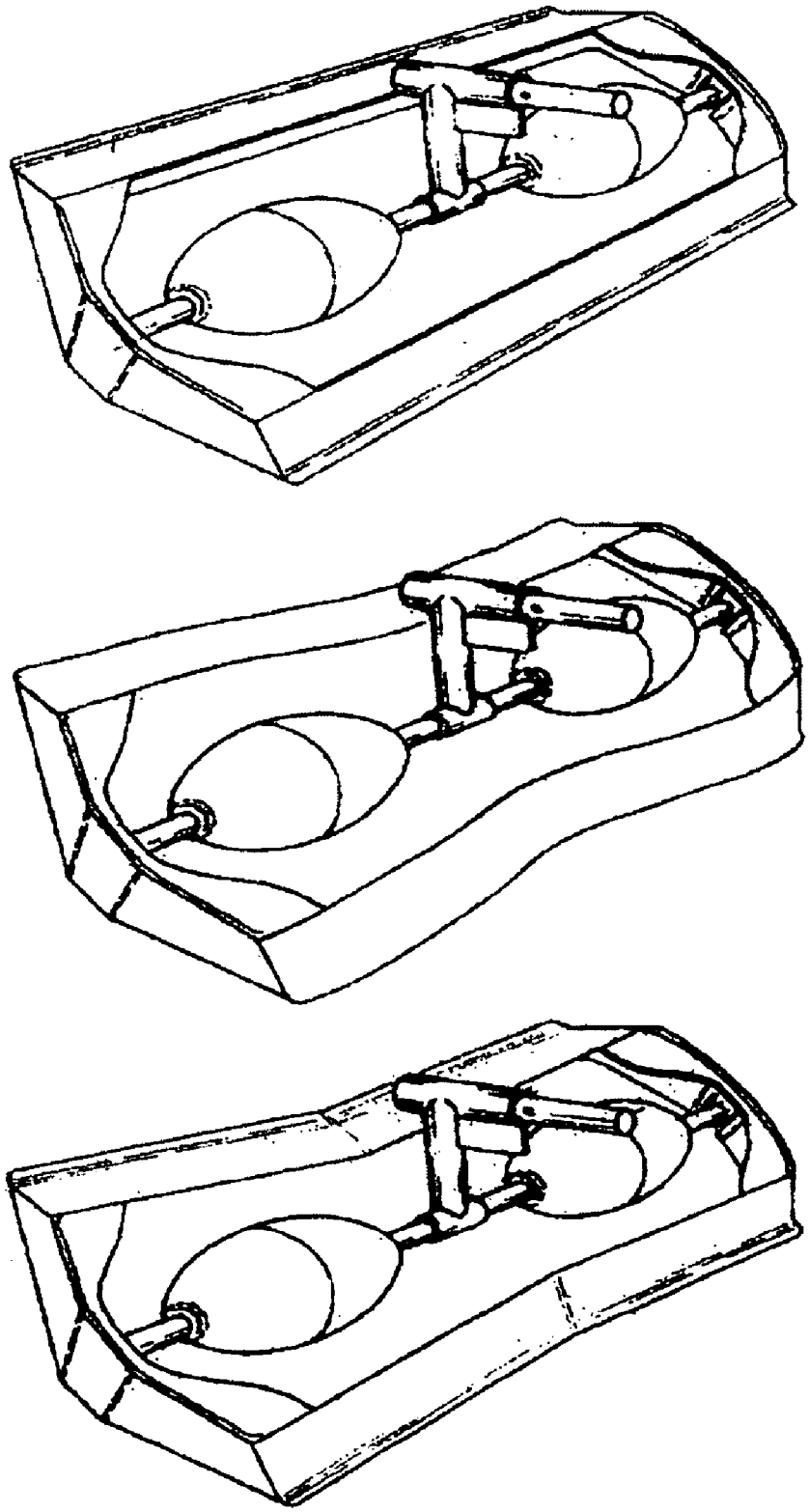
FIG. 13 Shows an example of several possible edge shapes.

Numerous sizes, shapes, and configurations of this invention swivel skimmer 10 can be built and used within the scope of the present invention. FIG. 13 shows several possible designs with various edge shapes, each of which appears to work about as well as the others.

Figure 14A:
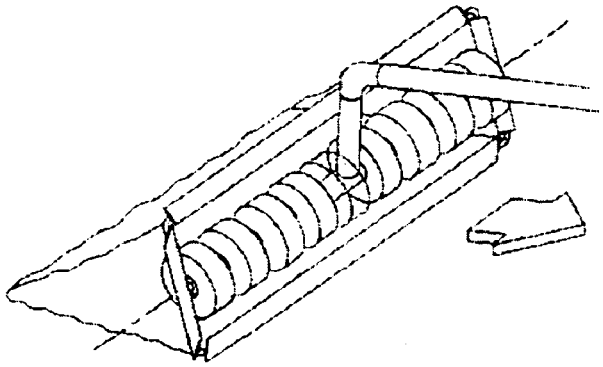
FIG. 14A thru 14L Show examples of several possible configurations of float location, pole and axle connections and configurations.
Figure 14B:
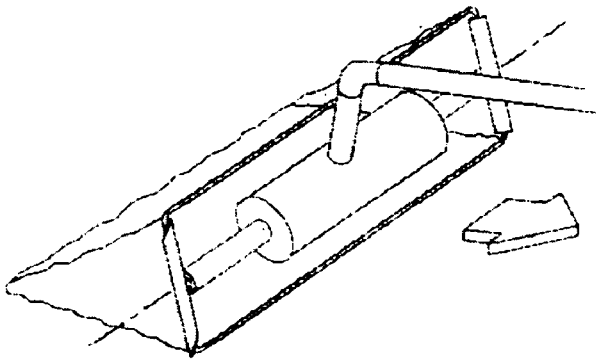
Figure 14C:
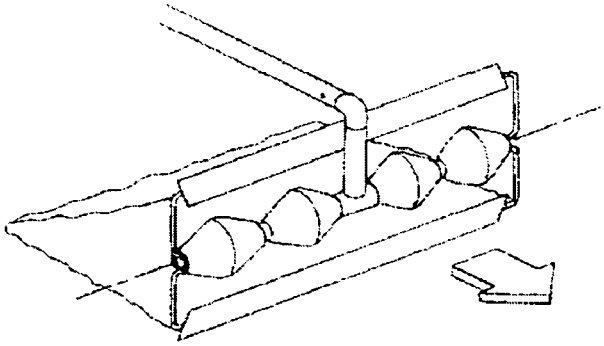
Figure 14D:
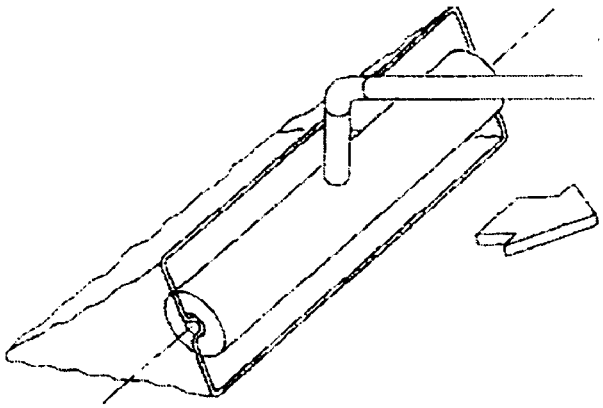
Figure 14E:
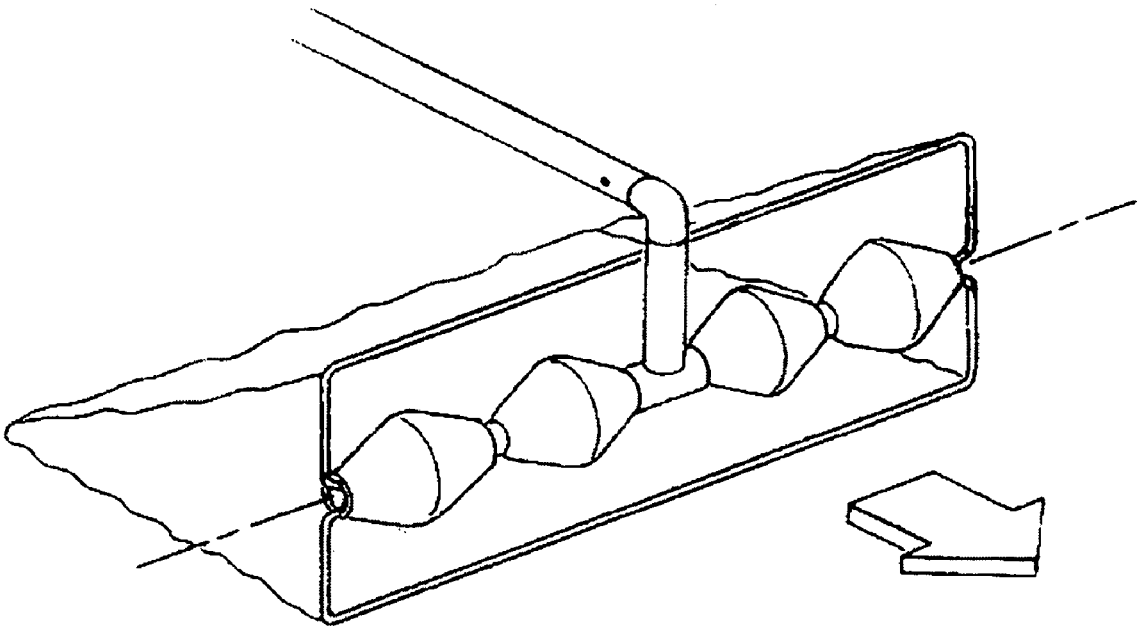
Figure 14F:
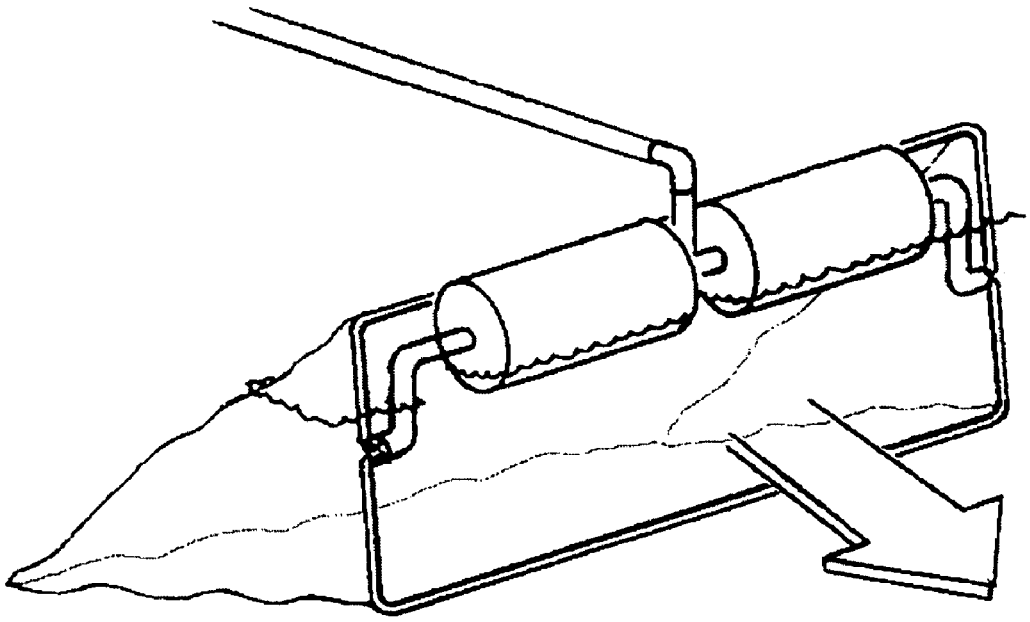
Figure 14G:
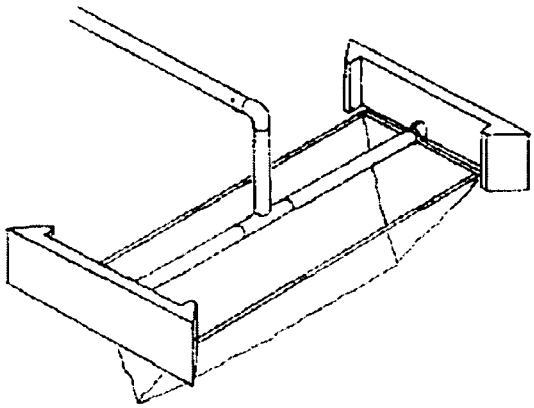
Figure 14H:
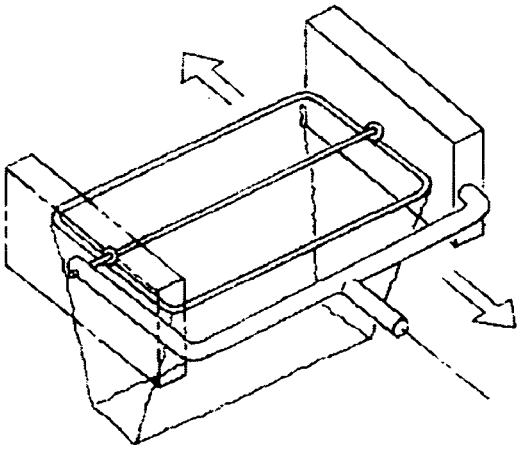
Figure 14I:
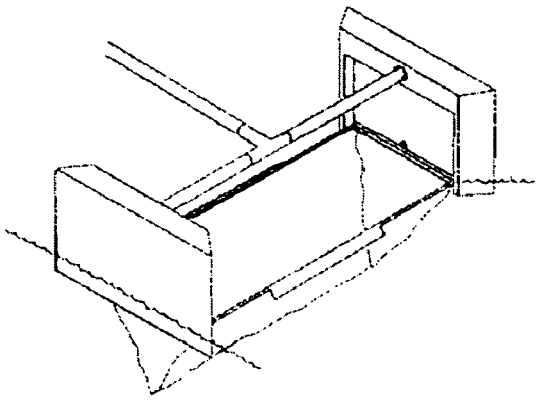
Figure 14J:
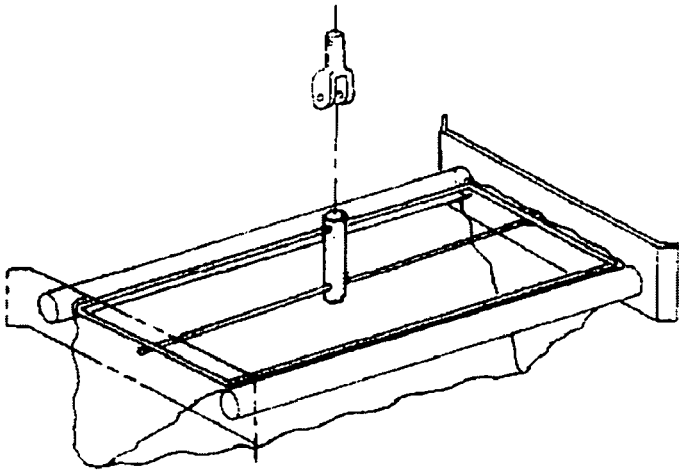
Figure 14K:
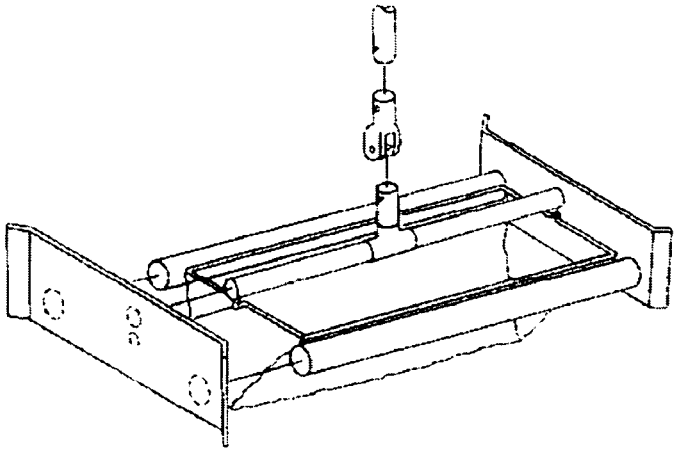
Figure 14L:
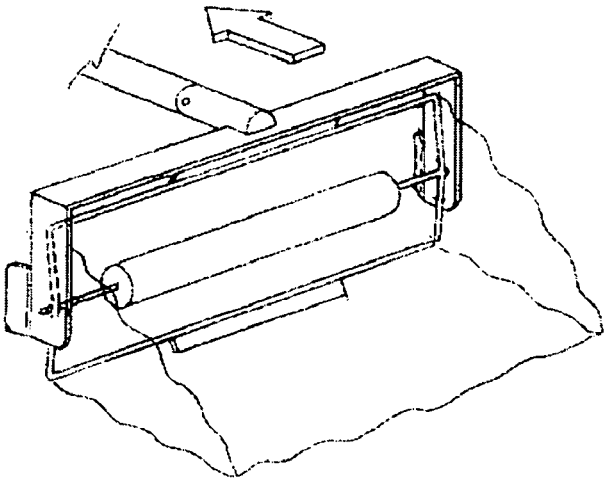
Figure 14M:
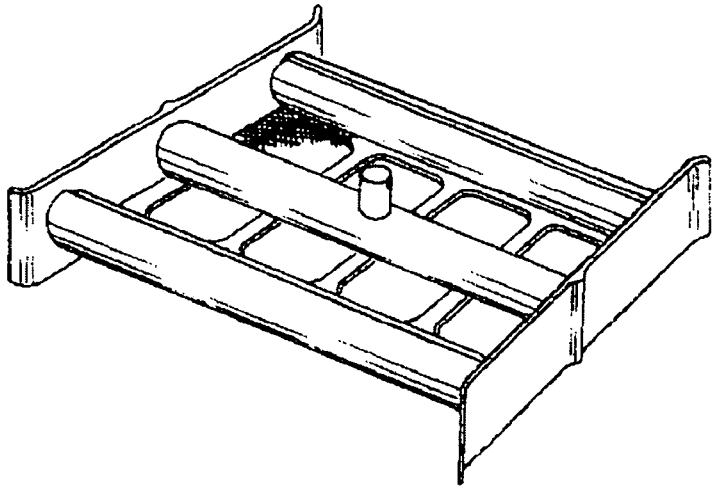
FIGS. 14*m*, 14*n* and 14*p* Show examples of the device configured with a tray as a collecting device.
Figure 14N:
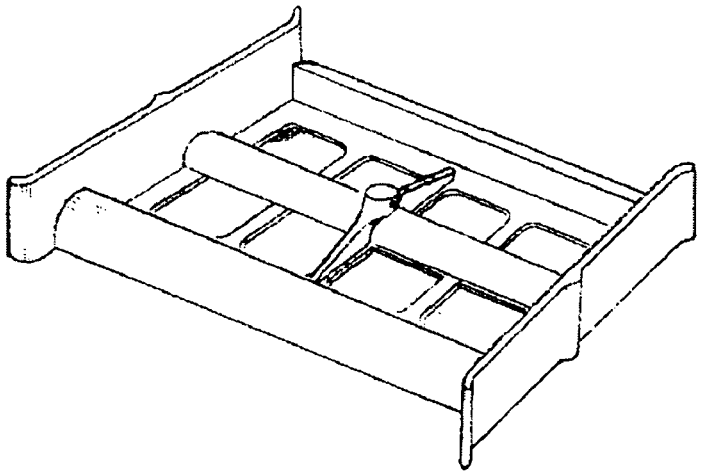
Figure 14P:
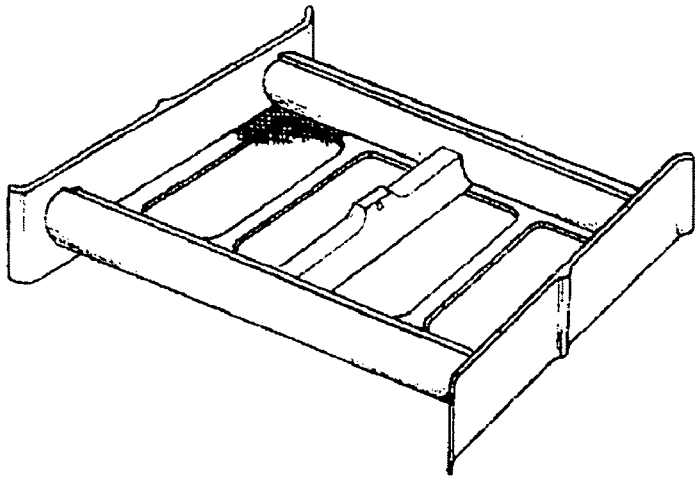

FIGS. 14*a–p* depict several more possible configurations of the inventive swivel skimmer 10. As can be seen from these examples, various configurations of floatation elements 12 are possible. FIGS. 14*a, b, c, d*, and *e* each have different floatation configurations along the central axis. FIG. 14*f* shows an example where the central axis element does not lie completely along the middle of the frame 30 opening. FIGS. 14*g*, 14*h* and 14*i* show examples where the floatation elements 12 are on the ends of the frame 30, rather than along the axis of pivoting. FIGS. 14*j* and 14*k* depict embodiments where the floatation is located on the leading and trailing edges. FIG. 14*i* also depicts a configuration with no riser 20 incorporated in the handle assembly 18. FIGS. 14*h* and 14*l* depict possible embodiments with alternative configurations of the handle assembly 18.

Figure 15:
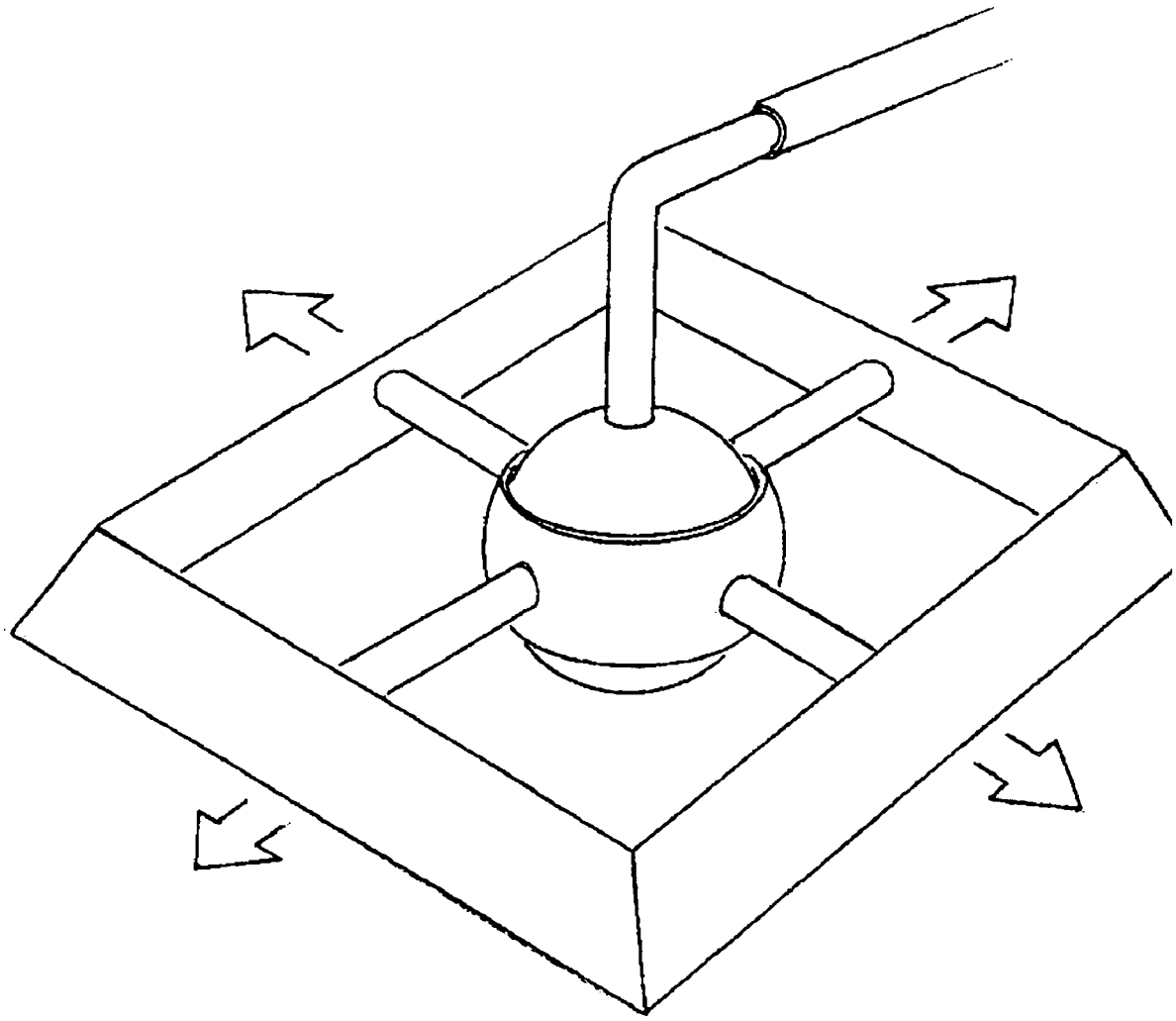
FIG. 15 Shows an example of an embodiment of the invention with a pivoting axis, allowing multi-directional skimming.
Figure 16:
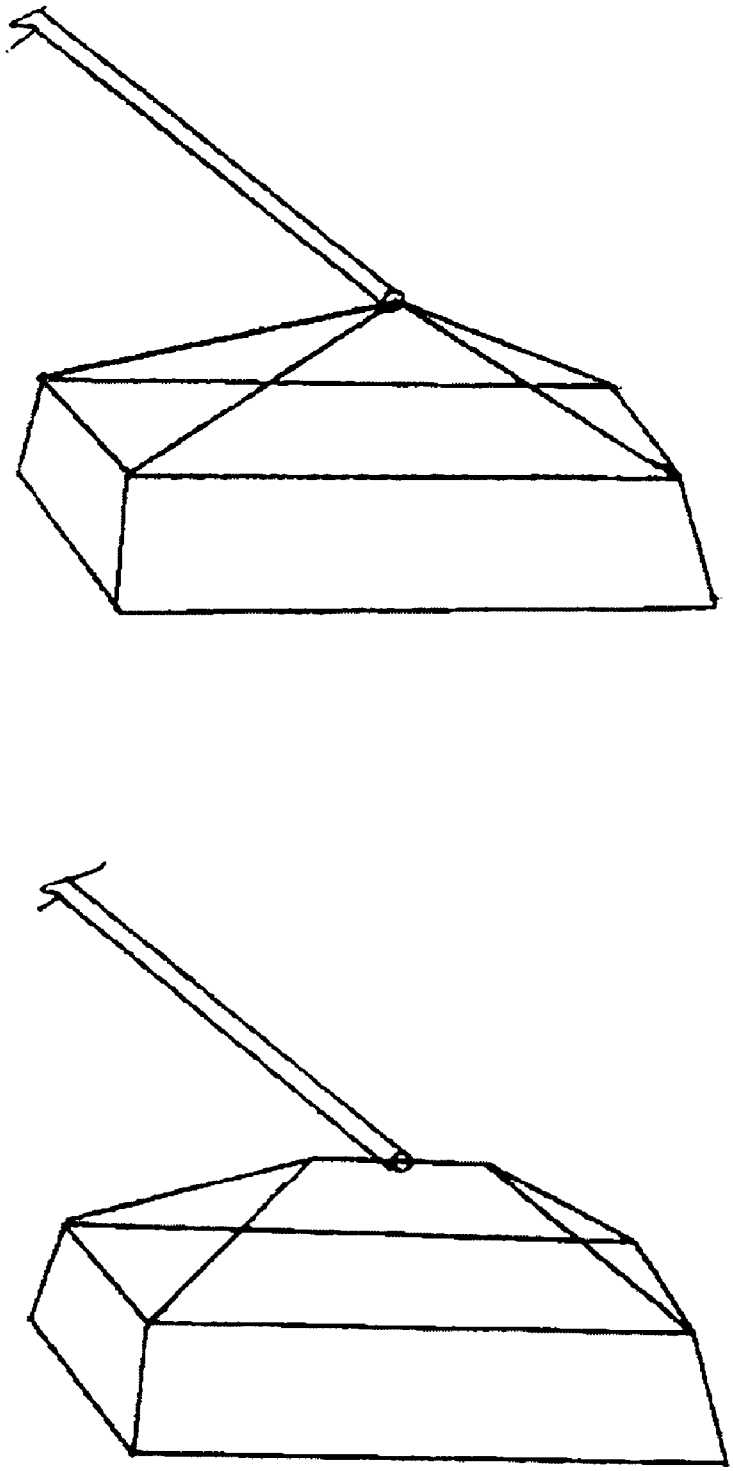
FIG. 16 Shows examples of the many different ways the pole handle can be attached, other than to a center riser or center yoke.

FIGS. 14*m*, 14*n* and 14*p* depict several additional configurations of the frame 30 portion of the skimmer 10, which have no descending net 32, but rather employ a flat tray with a screen to collect debris. Each of these FIGS. 14*a–p* demonstrate examples of configurations with and without many of the features described in the above preferred described embodiment, illustrating depth and breadth in the particular configurations of swivel skimmer 10 which is inherent within the scope of this invention. As a further example of possibilities within this invention. FIGS. 15 and 16 show embodiment of the swivel skimmer invention 10 which can swivel in more than one orientation, thus providing a multi-direction skimmer which can pivot along more than one axis. Obviously many other versions of swivel skimmer can be devised by those skilled in the arts which would fall within the intended and claimed scope of this invention.

What is claimed is:

1. A floating multi-directional liquid skimming device comprising;

A perimeter frame attached to a debris collection net, Where said frame is pivotally attached to a central axis element, located adjacent the mouth of the net such that the perimeter frame can rotate about a central axis, relative to the surface of the liquid, and A handle attachment element attached to the central axis element, and At least one floatation means attached to the liquid skimming device.

2. A floating multi-directional liquid skimming device as in claim 1, further comprising at least one positive buoyancy floatation element attached along the central axis element.

3. A floating multi-directional liquid skimming device as in claim 2, where said floatation elements are nominally circular in cross-section perpendicular to the central axis.

4. A floating multi-directional liquid skimming device as in claim 2, where said floatation elements are nominally oblong in shape.

5. A floating multi-directional liquid skimming device as in claim 2, with more than one floatation element, where said elements are located along the central axis element with a spacing gap between said elements.

6. A floating multi-directional liquid skimming device as in claim 2, with more than one floatation element, where said elements are located along the central axis element with a spacing gap between each of the outermost floatation element, and the perimeter frame.

7. A floating multi-directional liquid skimming device as in claim 1, where said perimeter frame is rotate-able relative to the handle attachment.

8. A floating multi-directional liquid skimming device as in claim 1, where said perimeter frame and collection net apparatus are removable from the central axis element, to facilitate dumping of collected debris.

9. A floating multi-directional liquid skimming device as in claim 1, where said handle attachment element further comprises a riser element to allow for clearance of the handle when said perimeter frame apparatus rotates relative to a handle.

10. A floating multi-directional liquid skimming device as in claim 9, where said riser element further comprises at least one swivel stop element to control the amount of rotation of said frame relative to the handle.

11. A floating multi-directional liquid skimming device as in claim 1, which further comprises floatation means to cause the perimeter frame to return quickly to a neutral floating position such that collected debris cannot float out of the collection apparatus when the motion of said collection apparatus is stopped.

12. A floating multi-directional liquid skimming device as in claim 1, where the outer edges of the perimeter frame at each end of the central axis element are tapered to facilitate cleaning of the side wall of a liquid containing vessel beneath a overhanging portion of the vessel edges.

13. A floating multi-directional liquid skimming device as in claim 1, where the outer edges of the perimeter frame at each end of the central axis element have a nominally flat central portion to facilitate cleaning the edges of a liquid containing vessel.

14. A floating multi-directional liquid skimming device as in claim 13, where the nominally flat portion has an outwardly flared shape to scrape the edges of a liquid containing vessel.

15. A floating multi-directional liquid skimming device as in claim 1, where the outer edges of the perimeter frame which are roughly parallel to the central axis are flared to cause rotation of the perimeter, frame, when a device operator begins a push or pull cleaning movement of the device.

16. A floating multi-directional liquid skimming device as in claim 1, where the outer edges of the perimeter frame which are roughly parallel to the central axis can trap air to cause these edges to float when the apparatus is stationary.

17. A floating multi-directional liquid skimming device as in claim 1, where the outer edges of the perimeter frame at each end of the central axis element, have at least a partial corner cover cap to prevent debris from floating out of the perimeter frame and escaping from said collection apparatus.

18. A floating multi-directional liquid skimming device as in claim 1, where the top edges of the perimeter frame which are roughly parallel to the central axis are angled inward to prevent previously-captured debris from splashing out when the apparatus reverses direction.

* * * * *